US007543781B2

(12) United States Patent
Mitjans

(10) Patent No.: US 7,543,781 B2
(45) Date of Patent: Jun. 9, 2009

(54) ANCHOR FOR INSTALLING A LECTERN

(75) Inventor: José Figueras Mitjans, Barcelona (ES)

(73) Assignee: Figueras International Seating, S.A, Barcelona (ES)

( * ) Notice: Subject to any disclaimer, the term of this patent is extended or adjusted under 35 U.S.C. 154(b) by 131 days.

(21) Appl. No.: 11/571,111

(22) PCT Filed: Aug. 4, 2005

(86) PCT No.: PCT/ES2005/000449

§ 371 (c)(1),
(2), (4) Date: Dec. 27, 2006

(87) PCT Pub. No.: WO2006/030047

PCT Pub. Date: Mar. 23, 2006

(65) Prior Publication Data

US 2008/0042022 A1 Feb. 21, 2008

(30) Foreign Application Priority Data

Aug. 6, 2004 (ES) ..... 200401924 U

(51) Int. Cl.
*F16L 3/00* (2006.01)

(52) U.S. Cl. ..... 248/49; 108/50.02; 248/298.1

(58) Field of Classification Search ..... 248/49, 248/186.1, 298.1, 297.21, 297.31; 108/50.02, 108/26, 23, 28, 30; 312/196, 223.6
See application file for complete search history.

(56) References Cited

U.S. PATENT DOCUMENTS

| | | | | | |
|---|---|---|---|---|---|
| 3,480,239 | A | * | 11/1969 | Jensen et al. | 410/79 |
| 4,094,256 | A | * | 6/1978 | Holper et al. | 108/50.02 |
| 4,163,867 | A | * | 8/1979 | Breidenbach | 174/481 |
| 4,185,799 | A | * | 1/1980 | Richards, Jr. | 244/118.5 |
| 4,762,072 | A | * | 8/1988 | Boundy et al. | 108/50.02 |
| 4,807,838 | A | | 2/1989 | Anderson | |
| 5,056,746 | A | | 10/1991 | Parson et al. | |
| 5,154,126 | A | * | 10/1992 | Newhouse et al. | 108/50.02 |
| 5,715,761 | A | | 2/1998 | Frattini | |
| 2004/0011932 | A1 | | 1/2004 | Duff | |

FOREIGN PATENT DOCUMENTS

| | | |
|---|---|---|
| ES | 1045194 | 8/2000 |

* cited by examiner

*Primary Examiner*—Korie Chan
(74) *Attorney, Agent, or Firm*—Lucas & Mercanti, LLP

(57) ABSTRACT

The invention relates to an improved anchor for installing a lectern, comprising a support column (1) which is fixed to an electric cable guide (5) by means of a base (3). According to the invention, one of the lateral edges of the base (3) comprises a rib (7) which corresponds to a longitudinal recess (14) on the inner part of one of the sides of the guide (5), while the other side of the base (3) comprises a crimp (8) which can be engaged with an inner step (15) on the other side of the guide (5).

2 Claims, 6 Drawing Sheets

ANCHOR FOR INSTALLING A LECTERN

FIELD OF THE ART

The present invention relates to lecterns arranged in convention and conferences halls and places where similar activities are held, and particularly lecterns supported by a column, possibly comprising acoustic or other means requiring an electrical installation, proposing a fixing anchor providing very advantageous constructive and functional features.

STATE OF THE ART

Solutions for lecterns are known comprising a support column having a base at the lower part for fixing it on the floor by means of screw elements, which can comprise electrically operated elements requiring an installation for such purpose, the wiring of which is included inside the support column, traversing the fixing base. Solutions of this type are, for example, those described in Utility Models ES 1,037,389 and ES 1,045,194.

Said solutions have the drawback that to access the wiring of the electric installation a costly disassembly and subsequent assembly of the anchor of the table, through which the wiring passes from the corresponding cable laying conventionally hidden under the floor.

OBJECT OF THE INVENTION

A fixing anchor for said lecterns supported by a support column is proposed according to the present invention, which anchor has been developed with features eliminating in a practical and advantageous manner the drawbacks of the conventional solutions, facilitating in a practical manner the assembly and disassembly of the lectern.

This anchor object of the invention has a base fixed to the support column of the lectern by means of screws, said base forming a fixing coupling with respect to a cable guide which is arranged fixed to the floor for extending the electrical wiring intended for the lectern therethrough.

The electric cable guide is a grooved U-shape guide, one of the sides having a longitudinal, preferably semicylindrical recess in the inner upper part, whereas the other side comprises a longitudinal step on the inner upper side.

A lateral side of the base fixed to the column comprising a rib with a shape corresponding to the longitudinal recess of the mentioned electric cable guide, while the other side comprises a device formed by an outwardly projecting retractable element.

An anchor is thereby obtained which allows installing the lectern by means of coupling the support column with respect to the guide arranged on the floor, the interlocking of the assembly by means of the simple fitting of one side of the base in the guide and the locking by means of the device of the other side by simple swiveling, while for disassembly it is only necessary to manipulate the interlocking device to release the crimp and to then swivel the column to extract the base from the coupling on the guide.

Such implementation allows incorporating the wiring for the electric installation of the lectern in optimal arrangement conditions given that the cable laying to the location of the lectern can be done by the guide placed on the floor, passing through the fixing base and through the support column to the corresponding elements comprised in the lectern; such wiring can be quickly and easily accessed, when needed, by means of the disassembly of the fixing anchor of the lectern.

In the assembly arrangement, the lower guide can be placed on or embedded in the floor or incorporated in the riser of a step or the like, allowing the installation to be adapted in the most suitable manner in each place.

Due to the aforementioned, said anchor object of the invention incidentally results from very advantageous features, being autonomous and preferably applied in comparison with the known solutions with the same application.

DETAILED DESCRIPTION OF THE INVENTION

Figure 1:
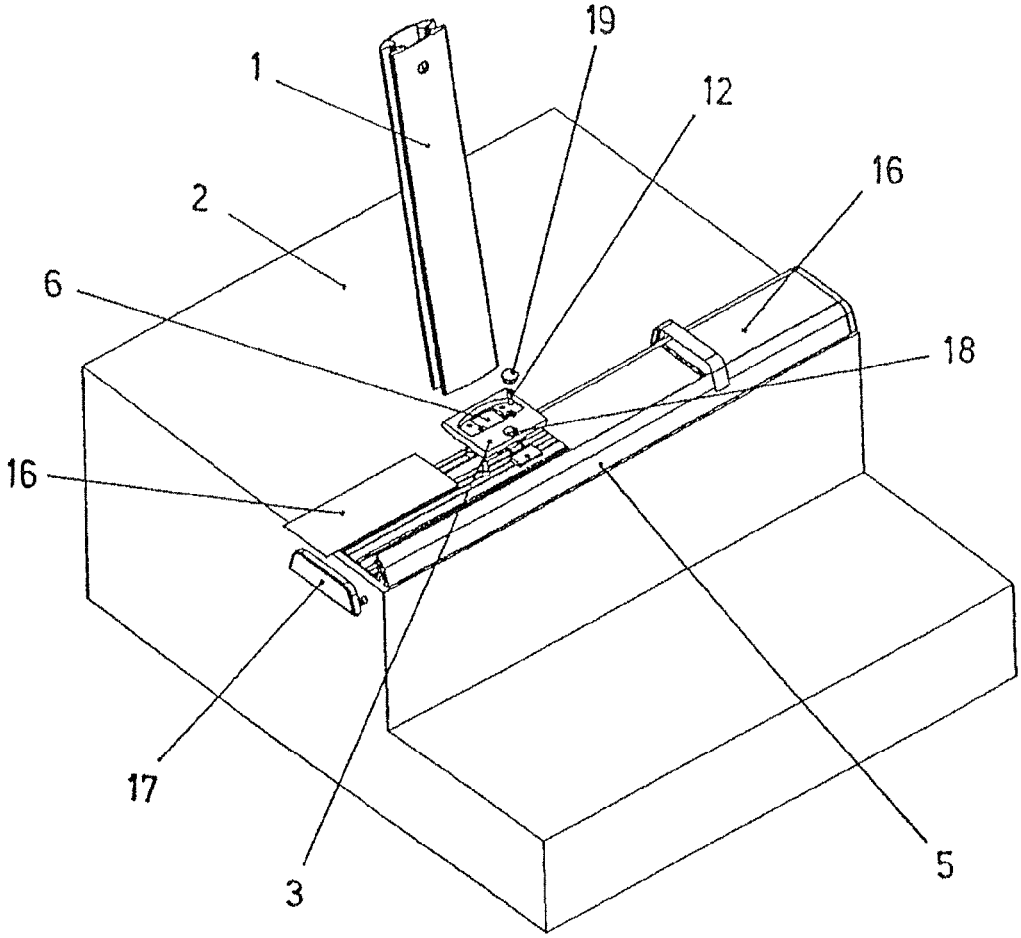
FIG. 1 shows an exploded perspective view of the support column for a lectern with the proposed anchor in an application arrangement.
Figure 2:
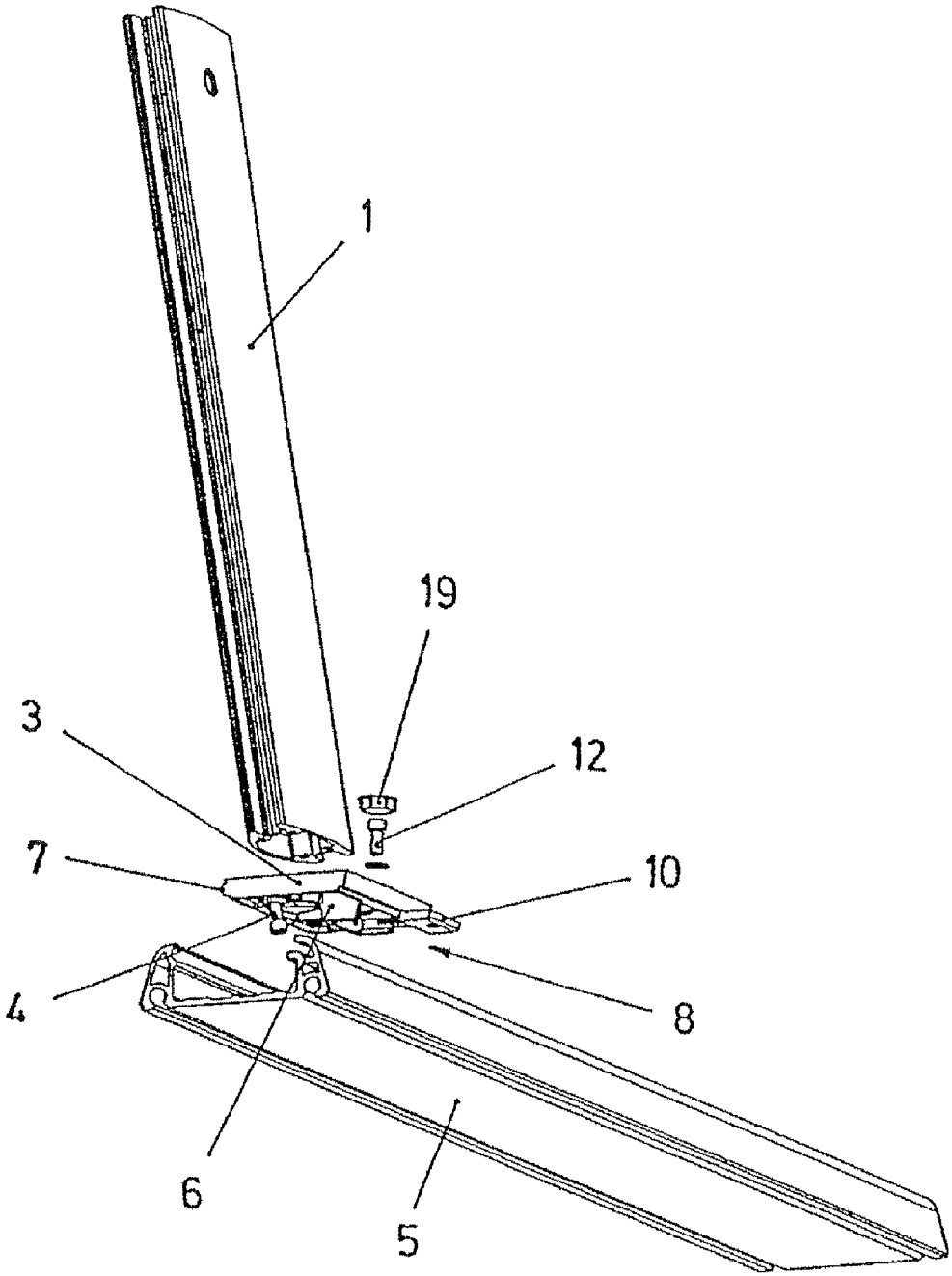
FIG. 2 shows an exploded perspective view of the assembly of the anchor of the invention.
Figure 3:
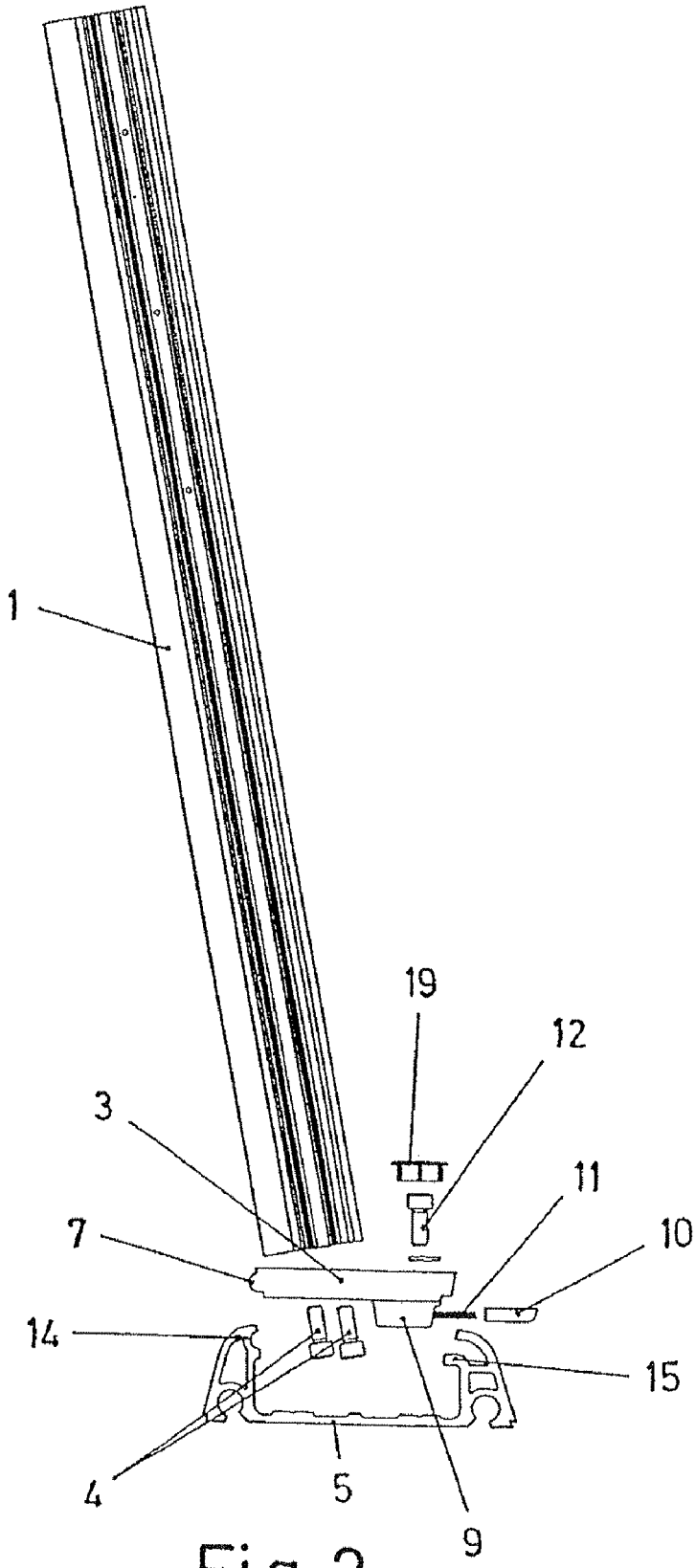
FIG. 3 shows an exploded side view of the same assembly of the previous figure.

The object of the invention relates to a fixing anchor for lecterns of the type placed in convention and conference halls, etc., and having a support column (1) which is fixed on the floor (2) in the place of application.

The anchor comprises a base (3) fixed on the lower end of the column (1) by means of screws (4), said base (3) being intended for forming the fixing coupling on a guide (5) fixed in the floor (2).

The base (3) comprises an opening (6) in the central part corresponding with the inner longitudinal hollow of the column (1) which is formed by a hollow profile such that the connection cables for electrical elements or apparatuses, such as lighting elements, acoustic equipment or the like which are incorporated in the lectern can pass through said base (3) and throughout the column (1).

One of the lateral edges of the base (3) has a preferably semicylindrically shaped rib (7), while the opposite side has a catch-like device (8).

The device (8) consists of a casing (9) where a mobile element (10) pushed by a spring (11) is housed, such that said mobile element (10) projects towards the side of the base (3), being able to be pushed back against the spring (11).

A screw (12) passes through the mobile element (10), which screw in turn passes through a slotted opening (13) of the base (3) such that when said screw (12) is loosened it allows the movement of the element (10) in the path enabled by the mentioned slotted opening (13), while by tightening the screw (12) the element (10) is fixed, preventing its movement.

The guide (5) is a grooved U-shaped guide, one of its side walls in the inner upper part comprising a longitudinal recess (14) corresponding with the shape of the side rib (7) of the base (3), while the inner upper part of the other side wall of the guide (5) comprises a longitudinal step (15) with respect to which the mobile element (10) of the device (8) of the base (3) can be engaged.

With this arrangement, the fixing of the column (1) in the installation assembly is carried out by means of coupling the base (3) in the guide (5), engaging the side rib (7) of the base (3) in the recess (14) of the guide (5), such that once it is engaged, it is enough to swivel the assembly of the column (1) and the base (3) for the element (10) of the device (8) to engage with the step (15), thus forming the fixing interlock.

For the element (10) to engage with the step (15), like a latch, the end of said element (10) is provided in a bevel shape such that when the screw (12) is loosened, the fixing interlocking occurs due to the pressure created when swiveling the base (3) towards the coupling position.

Once the lock is carried out by means of tightening the screw (12) the locking of the element (10) is formed, the coupling being assured. Disassembly can be carried out by loosening the screw (12), movement of the element (10) thereby being free, being able to be moved with the screw (12) against the spring (11) for disengaging it from the step (15), such that the base (3) can then be swiveled for its extraction from the guide (5).

The guide (5) is closed with upper covers (16) and end covers (17) by means of which an aesthetic assembly is determined, being able to internally incorporate the electric cables for the connections for the apparatuses of the lectern of application.

The screw (12) for holding and locking the mobile element (10) of the locking device (8) for the fixing is pushed into a hollow (18) of the base (3) where an aesthetic cover (19) is also arranged.

Figure 4:
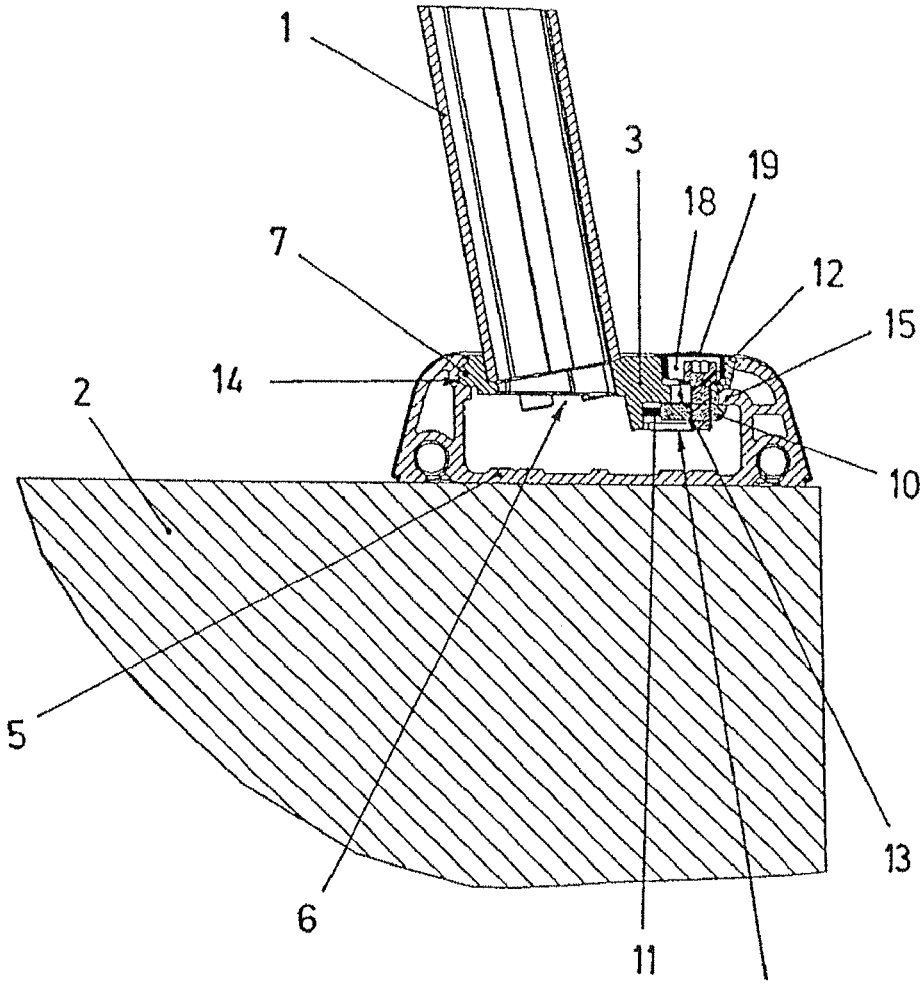
FIG. 4 shows a cross-sectional view of the anchor assembled in an application arrangement with the guide placed on the floor.
Figure 5:
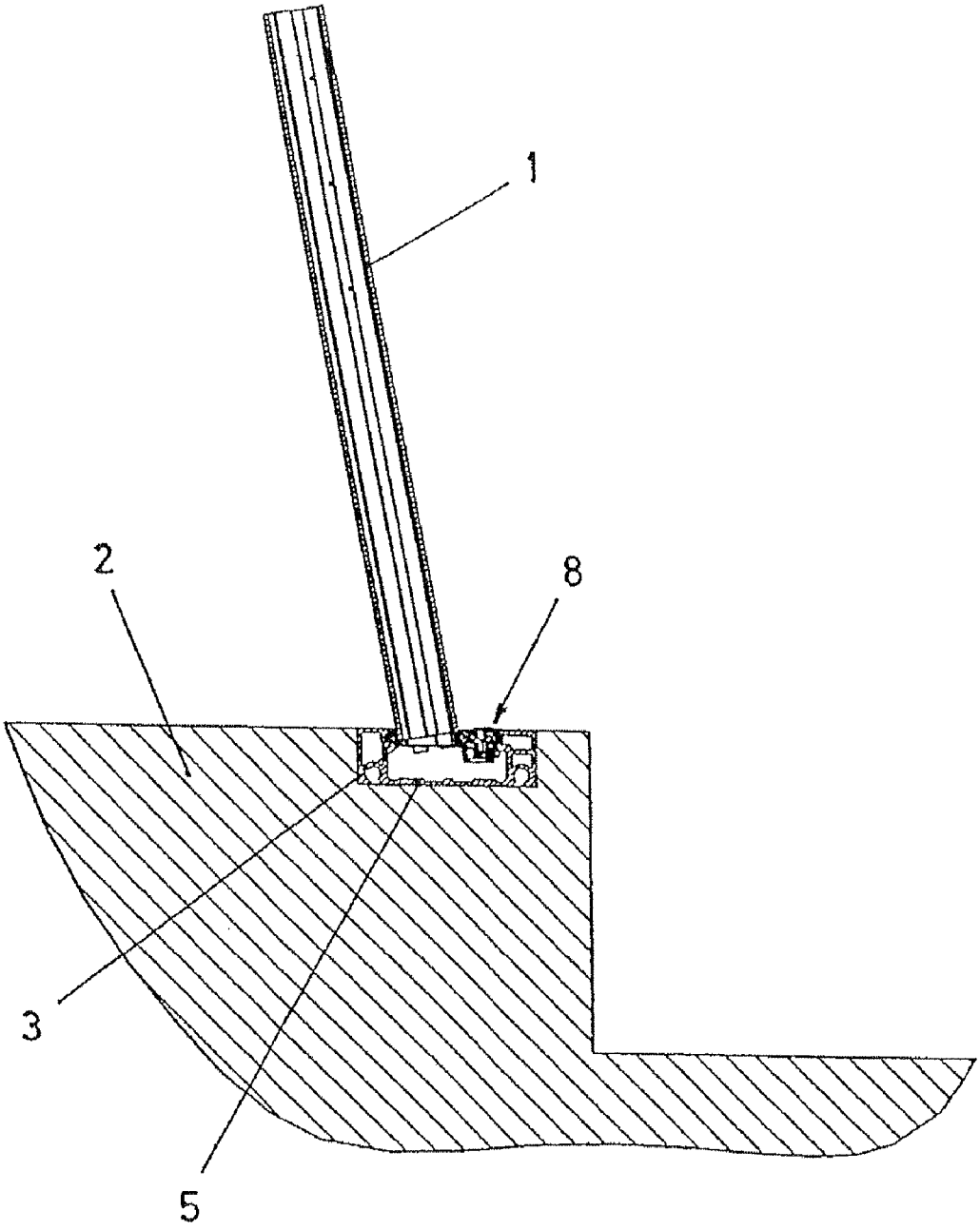
FIG. 5 shows a cross-sectional view of the anchor in an anchor application with the guide embedded in the floor.
Figure 6:
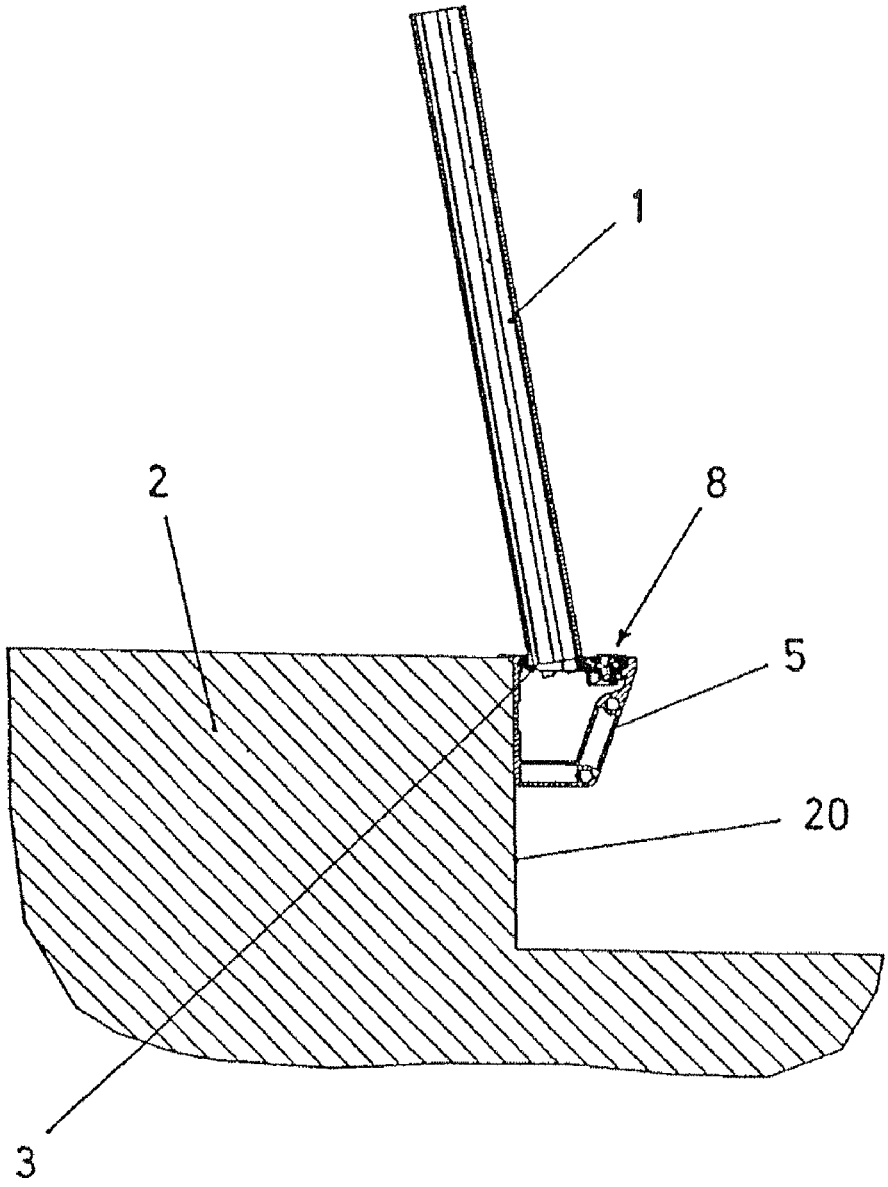
FIG. 6 shows a cross-sectional view of the anchor in an arrangement application with the guide fixed on the riser of a step.

The arrangement of the anchor can be provided with the guide (5) placed on the floor (2) in the place of application without altering the features discussed, as shown in FIGS. 1 and 4, or the guide (5) can be embedded in the corresponding floor (2), as shown in FIG. 5, also being able to be arranged with the guide (5) fixed in the riser (20) of a step or elevated floor, as shown in FIG. 6, such that the application of the assembly can be adapted in the installation to any location and in the most suitable manner in each case.

The invention claimed is:

1. An improved anchor for installing a lectern, comprising a support column fixed in the corresponding location by means of a base; and a guide is arranged on the floor of the place of application; wherein, a side edge of the base comprises a rib corresponding with a side recess in an inner part of one side of the guide; another side of said base comprises a crimp device which engages a step provided in the other side of the guide; the crimp device is formed by a mobile element which is pushed by a spring towards a position projecting from the side of the base; said element is retained by a screw passing through a slotted opening of the base.

2. An improved anchor for installing a lectern according to claim 1, wherein the guide can be arranged on or embedded in the floor in the place of application, or it can be incorporated on a riser of a step.

* * * * *